US006276952B1

(12) United States Patent
Ferranti et al.

(10) Patent No.: US 6,276,952 B1
(45) Date of Patent: Aug. 21, 2001

(54) LINE CORD RETENTION BRACKET FOR ELECTRONICS CHASSIS AND METHOD USE THEREOF

(76) Inventors: Stephen A. Ferranti, 2600 Preston Rd, Apartment No. 511, Plano, TX (US) 75093; Tavatchai Siritanapivat, 3413 Sea Breeze La., Rowlett, TX (US) 75088; Joanne Zhang, 8812 Christian Ct., Plano, TX (US) 75025

( * ) Notice: Subject to any disclaimer, the term of this patent is extended or adjusted under 35 U.S.C. 154(b) by 0 days.

(21) Appl. No.: 09/526,828

(22) Filed: Mar. 16, 2000

(51) Int. Cl.[7] ..... H01R 13/62
(52) U.S. Cl. ..... 439/345; 439/373
(58) Field of Search ..... 439/345, 359, 439/378, 371, 373; 174/54, 66, 67; 248/51, 74.2

(56) References Cited

U.S. PATENT DOCUMENTS 1,143,536 * 6/1915 Goodridge ..... 439/373 X
2,149,549 * 3/1939 Reis ..... 439/345 X
3,067,402 * 12/1962 Thaw ..... 439/359
5,409,394 * 4/1995 Astier ..... 439/373 X
5,472,355 * 12/1995 Wittmann ..... 439/373
6,071,142 * 6/2000 Blackman ..... 439/373

* cited by examiner

*Primary Examiner*—Renee Luebke

(57) ABSTRACT

For use with an electronics chassis having a chassis plug mounted to a wall thereof, a retention bracket for securing an outlet end of a line cord to the chassis plug and methods of operating and manufacturing the same. In one embodiment, the bracket includes: (1) a strap that defines a receiver for accepting and surrounding a body of the outlet end, the strap terminating in first and second locking members projecting radially from the receiver and having corresponding alignable first and second strap apertures and (2) first and second chassis anchors projecting from the strap in a direction substantially parallel to a centerline of the receiver, the outlet end engageable with the chassis plug, the first and second chassis anchors lockable with the wall via corresponding chassis apertures therein, a brace projecting from the wall and having a brace aperture aligning with the first and second strap apertures.

14 Claims, 2 Drawing Sheets

LINE CORD RETENTION BRACKET FOR ELECTRONICS CHASSIS AND METHOD USE THEREOF

TECHNICAL FIELD OF THE INVENTION

The present invention is directed, in general, to electronics chasses and, more specifically, to a line cord retention bracket employable to secure a line cord to an electronics chassis and method of manufacturing and using such bracket.

BACKGROUND OF THE INVENTION

Chasses are traditionally employed to encase and support electronic equipment, such as audio equipment, personal computers or television sets. Such electronic equipment requires electrical power to operate. A "line cord" is commonly employed to convey the necessary power from (typically) a wall outlet to the equipment.

In older equipment, line cords were permanently fixed (or "hard-wired") to their respective pieces of electronic equipment. One conventional configuration called for the line cord to exit the chassis through a modest aperture of perhaps twice the diameter of the cord. A compliant grommet or plastic through-hole clamp was interposed between the line cord and the edge of the aperture to protect the insulation about the line cord from being cut on the edge. A strain relief knot (in the case of a grommet) or the through-hole clamp itself further functioned to prevent any pulling forces that may be exerted on the line cord from being transmitted to its termination within the chassis, and thus reducing the risk of harm to the equipment.

Although hard-wired line cords were not dramatically disadvantageous (and, for that reason, are still in wide use today), some problems were experienced. For example, cord management became an issue with longer line cords. If the electronic equipment was desired to be moved, something had to be done about the line cord; either it was hastily wrapped around the chassis or bundled and tied to keep it neat. Further, as hard-wired line cords aged, they became brittle and tended to fatigue, particularly where they met the grommet or through-hole clamp. Because they were hard-wired, workmanlike replacement meant opening the chassis, disconnecting (perhaps by unsoldering) the line cord from its electrical connections in the chassis, untying any strain relief knot or releasing the through-hole clamp (not usually trivial) and finally reversing these steps to install the new line cord.

To address these disadvantages, more expensive electronic equipment is provided with removable line cords. One popular configuration calls for a countersunk plug to be located on a wall of the chassis. A line cord having a plug on one end and an outlet on the other is then employed. The outlet end is coupled to the countersunk plug and the plug end is plugged into a wall outlet. One widely-used type of plug and outlet is called an "IEC" (International Electrotechnical Commission) connector. IEC connectors are described, for example, in IEC Standard 60320, which is incorporated herein by reference. Those skilled in the pertinent art will recognize IEC connectors as being widely used in personal computers.

Unfortunately, removable line cords are not without their own problems. Perhaps the most common problem associated with using a removable line cord is the ease with which the line cord outlet can accidentally be separated from the plug on the chassis wall, having its most undesirable consequence when the equipment is being used. Separation may result if someone trips over a line cord or as the equipment itself is moved. Complete separation need not even occur; separation sufficient to break a single power connection to the chassis will interrupt the flow of current and cripple the equipment.

To address this problem, line cord retaining brackets were introduced. Today's line cord retaining brackets comprise a clamp that constricts about the body of the line cord outlet end. The clamp has two side-projecting flanges that, after the outlet is joined to the countersunk plug, are screwed to the chassis wall.

Although conventional line cord retaining brackets provide some benefits, they also bring some problems. First, conventional retaining brackets require multiple screws to affix the retaining brackets to the chassis wall. As a result, the task of coupling the retaining bracket to the chassis wall requires a screwdriver not only to clamp the bracket about the body of the line cord outlet, but also to mount the bracket to the chassis wall. Second, because the typical retaining bracket requires screws to hold it in position, the flanges must be large enough to accept the threads, and bear against the heads, of the mounting screws. As a result, conventional retaining brackets consume a significant amount of chassis wall area. As electronics chasses shrink, and their wall area is called upon to accommodate increasing numbers and sizes of features (such as switches, lights and cooling fans), the retaining bracket area penalty becomes evermore prominent.

Accordingly, what is needed in the art is a line cord retaining bracket that is faster and easier to couple to, and decouple from, a chassis wall, and occupies less area of the chassis wall, than those found in the prior art. In addition, what is needed in the art are methods of operating and manufacturing such retaining brackets.

SUMMARY OF THE INVENTION

To address the above-discussed deficiencies of the prior art, the present invention provides, for use with an electronics chassis having a chassis plug mounted to a wall thereof, a retention bracket for securing an outlet end of a line cord to the chassis plug and methods of operating and manufacturing the same. In one embodiment, the bracket includes: (1) a strap that defines a receiver for accepting and surrounding a body of the outlet end, the strap terminating in first and second locking members projecting radially from the receiver and having corresponding alignable first and second strap apertures, (2) first and second chassis anchors projecting from the strap in a direction substantially parallel to a centerline of the receiver, the outlet end engageable with the chassis plug, the first and second chassis anchors lockable with the wall via corresponding chassis apertures therein, a brace projecting from the wall and having a brace aperture aligning with the first and second strap apertures and (3) a fastener, passable through the first strap aperture, the brace aperture and the second strap aperture to constrict the receiver and secure the body with respect to the strap, the first and second chassis apertures and the fastener cooperating to secure the retention bracket with respect to the wall and thereby the outlet end with the chassis plug.

The present invention therefore introduces the broad concept of engaging the wall of a chassis with a bracket in a fundamentally different way. Instead of requiring multiple fasteners to connect the bracket to the wall, space-efficient chassis anchors are used to lock with the wall and cooperate with a single fastener to secure the bracket to the wall. The present invention enjoys substantial utility in that it requires fewer fasteners and is therefore faster to secure and remove than prior art retention brackets and, in one embodiment, employs chassis anchors that require less chassis wall area than prior art mounting flanges.

In one embodiment of the present invention, the strap has a shape that conforms to a perimeter of the body. Conforming to the body perimeter advantageously increases the clamping effect of the strap on the body.

In one embodiment of the present invention, the outlet end contains an International Electrotechnical Commission (IEC) connector. Of course, the broad scope of the present invention is not limited to a particular type, current rating or configuration of outlet or plug.

In one embodiment of the present invention, the strap comprises metal. The strap may alternatively comprise plastic or any other suitable material.

In one embodiment of the present invention, the second strap aperture is bounded by threads. In a related embodiment, the fastener is a single bolt. Alternatively, a separate nut may be used, or the first and second locking members may be held together by any other fastening or clamping structure.

In one embodiment of the present invention, the bracket further includes first and second chassis anchor offsets, interposed between the strap and the first and second chassis anchors, respectively, that increase a separation of the first and second chassis anchors. The chassis anchor offsets, while not required by the present invention, advantageously allow additional separation between the chassis apertures and the chassis plug, which typically increases the overall force that the bracket can exert on the chassis wall without deforming the wall proximate the chassis apertures.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
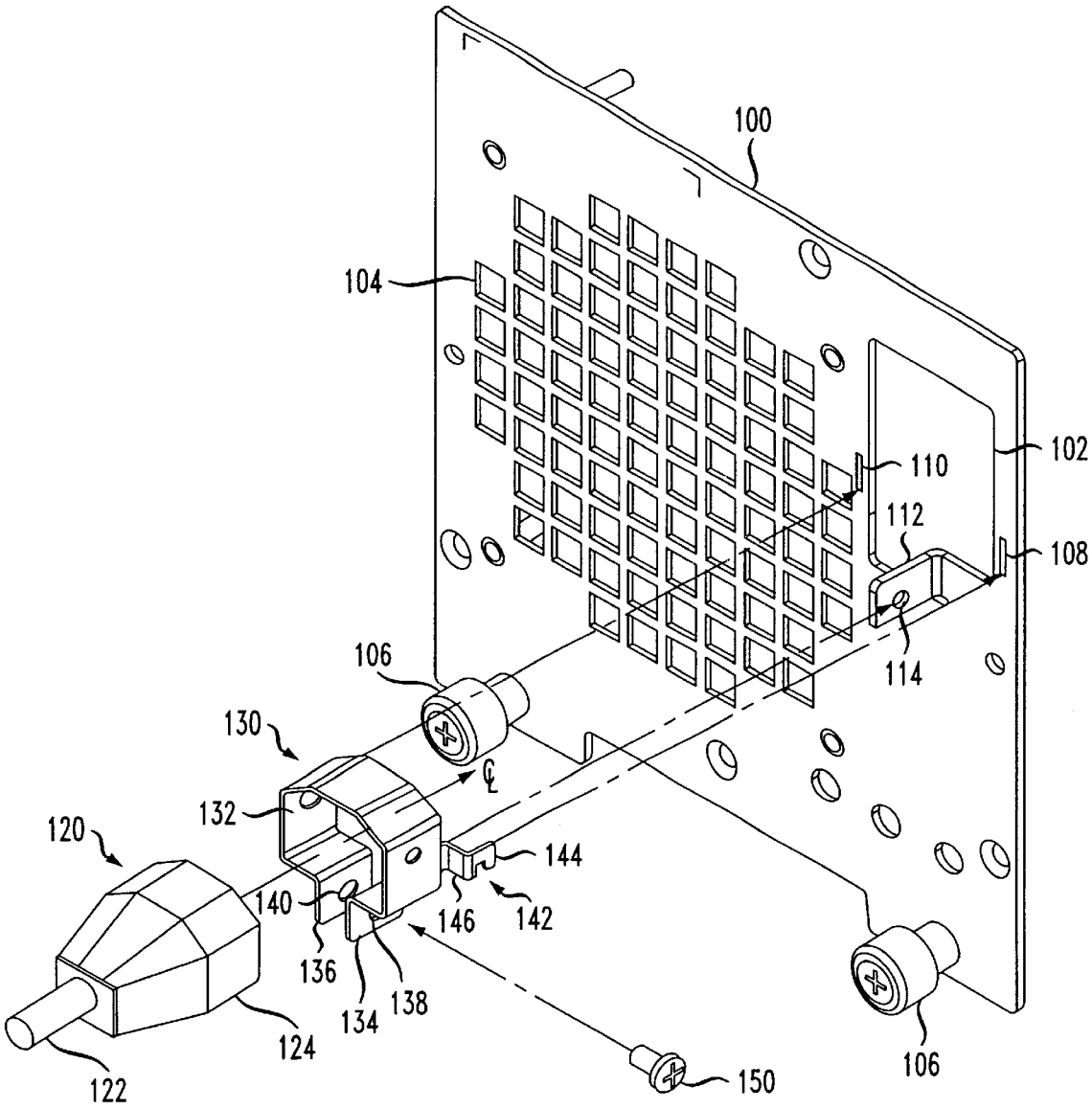
FIG. 1 illustrates an exploded isometric view of a chassis wall, a line cord and a retention bracket constructed according to the principles of the present invention.

Referring initially to FIG. 1, illustrated is an exploded isometric view of a chassis wall 100, a line cord 120 and a retention bracket 130 constructed according to the principles of the present invention. The chassis wall 100 includes a chassis plug aperture 102 in which a chassis plug (not illustrated) is located. An outlet end 124 of the line cord 120 passes through the plug aperture 102 as the line cord 120 is coupled to the chassis plug. The chassis wall 100 further includes ventilation apertures (one of which is designated 104) that allow air to pass through the chassis wall 100 and communicate with a cooling fan (not illustrated) to maintain an acceptable temperature for components (not illustrated). The chassis wall 100 further includes mounting screws 106 that secure the chassis wall 100 to remaining chassis portions (not shown). The chassis wall 100 still further includes first and second chassis apertures 108, 110 and a projecting chassis brace 112 having a brace aperture 114.

The line cord 120 includes an insulated cord 122 and an outlet end 124. The insulated cord 122 is employed to transmit electrical current therethrough. The outlet end 124 of the line cord 120 passes through the chassis plug aperture 102 and couples to the chassis plug located within the chassis wall 100. In the illustrated embodiment, the outlet end 124 of the line cord 120 contains an IEC connector. Of course, the broad scope of the present invention is not limited to a particular type, current rating or configuration of the outlet end 124. In addition, the present invention is not limited to a particular type, current rating or configuration of the insulated cord 122 used in the line cord 120.

The retention bracket 130 includes a strap 132 that defines a receiver. The strap 132 accepts and surrounds the body of the outlet end 124 of the line cord 120 as the outlet end 124 passes through the receiver. In the illustrated embodiment, the strap 132 has a shape that conforms to a perimeter of the body of the outlet end 124. Conforming to the perimeter of the body of the outlet end 124 advantageously increases the clamping effect of the strap 132 on the body. However, the strap 132 is not limited to any particular shape, and the present invention is broad enough to encompass a strap 132 of any shape. In addition, the illustrated strap 132 is manufactured from metal. However, the strap 132 may alternatively be manufactured from plastic or any other suitable material. In a manner to be shown in greater detail, the chassis brace 112 cooperates with the retention bracket 130 and the anchor arms 144 to secure the retention bracket 130 to the chassis wall 100 and thereby the line cord 120 to the chassis plug.

The retention bracket 130 further includes alignable first and second locking members 134, 136 projecting from the strap 132. The locking members 134, 136 project radially from the centerline illustrated (though not separately referenced) in the receiver formed by the strap 132. In addition, the first locking member 134 includes a first strap aperture 138, and the second locking member 136 includes a second strap aperture 140. The retention bracket 130 still further includes first and second chassis anchors (one of which is designated 142) projecting from one side of the strap 132. The first and second chassis anchors 142 project in a direction that is substantially parallel to the centerline of the receiver formed by the strap 132. The first and second chassis anchors 142 include corresponding first and second anchor arms (one of which is designated 144) for locking with the chassis wall 100 through the first and second chassis apertures 108, 110, respectively.

FIG. 1 further illustrates a fastener 150. In the illustrated embodiment, the fastener 150 is a single bolt. In addition, the second strap aperture 140 is illustrated as being bounded by threads. Alternatively, a separate nut (not illustrated) may be used, or the first and second locking members 134, 136 may be held together by any other fastening or clamping structure.

The retention bracket 130 is employed to secure the line cord 120 to the chassis wall 100 as follows. The body of the outlet end 124 is passed through the receiver formed by the strap 132. Once through the receiver, the body of the outlet end 124 is also passed through the chassis plug aperture 102 and coupled to the chassis plug. The first and second chassis anchors 142 are then passed through the corresponding first and second chassis apertures 108, 110 where the first and second anchor arms 144 lock with the chasis wall 100.

In the illustrated embodiment, the retention bracket 130 further includes first and second chassis anchor offsets (one of which is designated 146), interposed between the strap 132 and the first and second chassis anchors 142, respectively. Employing the chasis anchor offsets 146 increase the separation of the first and second chassis anchors 142. The chassis anchor offsets 146, while not required by the present invention, advantageously allow additional separation between the chassis apertures 108, 110 and the chassis plug aperture 102, which typically increases the overall force that the retention bracket 130 can exert on the chasis wall 100 without deforming the chassis wall 100 proximate chassis apertures 108, 110.

Next, the fastener 150 is passed through the first strap aperture 138 of the first locking member 134, through the brace aperture 114 of the chassis brace 112, then through the second strap aperture 140 of the second locking member 136. As the fastener 150 is tightened, the receiver of the strap 132 is constricted around the body of the outlet end 124 of the line cord 120 to secure the strap 132 and the body of the outlet end 124 together. In this manner, the first and second locking members 134, 136, the chassis brace 112, the fastener 150, and the anchor arms 144 cooperate to secure the retention bracket 130 to the chassis wall 100 and the line cord 120 to the chassis plug. Specifically, once the fastener 150 is in place, the anchor arms 144 are passed through and locked within the chassis apertures 108, 110. Thus, the retention bracket 130 is locked with the chassis wall 100, helping to retain the line cord 120 in place.

The retention bracket 130 illustrated in FIG. 1 achieves significant advantages over retention brackets found in the prior art. Instead of requiring multiple fasteners to connect the retention bracket 130 to the chassis wall 100, the present invention employs space-efficient chassis anchors 142. The chassis anchors 142 are used to lock with the chassis wall 100 and cooperate with a single fastener 150 to secure the retention bracket 130 to the chassis wall 100.

Figure 2:
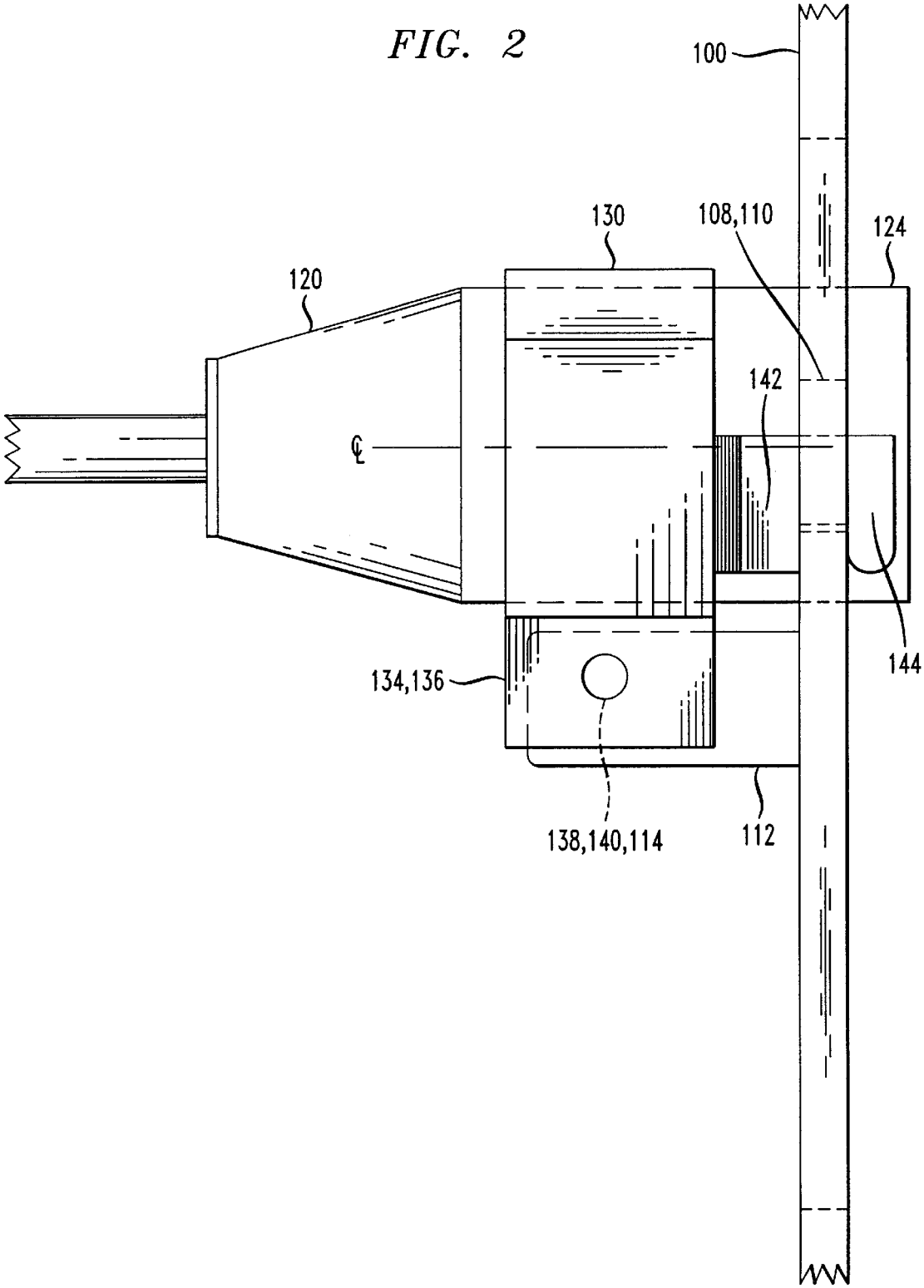
FIG. 2 illustrates a retention bracket, constructed according to the principles of the present invention, securing a line cord to a chassis wall.

Turning now to FIG. 2, illustrated is a side elevational view of the retention bracket 130 of FIG. 1 as the bracket 130 is employed to secure a line cord 120 to a chassis wall 100. FIG. 2 is included primarily to illustrate the alignment of the chassis anchors 142 with the chassis wall 100, and the locking members 134, 136 with the chassis brace 112. After the body of the outlet end 124 of the line cord 120 is passed through the strap 132, the chassis anchors 142 are passed through the chassis apertures 108, 110. Once through, the retention bracket 130 is moved slightly downward so that the anchor arms 144 engage the side of the chassis wall 100 opposite the retention bracket 130. By positioning the retention bracket 130 so that the anchor arms 144 are locked with the chassis wall 100 through the chassis apertures 108, 110, the first and second strap apertures 138, 140 and the chassis brace aperture 114 become substantially aligned.

Once the apertures 138, 140, 114 are aligned, the single fastener (not illustrated) may pass through the first and second locking members 134, 136 and the chassis brace 112. As discussed above, the single fastener both constricts the strap 132 around the body of the outlet end 124 of the line cord 120, and secures the line cord 120 to the chassis plug (not illustrated) located within the chassis wall 100. To remove the line cord 120 from the chassis plug, only the single fastener need be removed. By removing the single fastener, the strap 132 loosens and therefore no longer clamps the body of the outlet end 124 of the line cord 120 and the line cord 120 can be removed from the retention bracket 130. Then, the user may simply move the retention bracket 130 slightly upward and extract the retention bracket 130 from the chassis wall 100 quickly and easily, and without requiring a tool.

Although the present invention has been described in detail, those skilled in the art should understand that they can make various changes, substitutions and alterations herein without departing from the spirit and scope of the invention in its broadest form.

What is claimed is:

1. For use with an electronics chassis having a chassis plug mounted to a wall thereof, a retention bracket for securing an outlet end of a line cord to said chassis plug, comprising:

a strap that defines a receiver for accepting and surrounding a body of said outlet end, said strap terminating in first and second locking members projecting radially from said receiver and having corresponding alignable first and second strap apertures;

first and second chassis anchors projecting from said strap in a direction substantially parallel to a centerline of said receiver, said outlet end engageable with said chassis plug, said first and second chassis anchors lockable with said wall via corresponding chassis apertures therein, a brace projecting from said wall and having a brace aperture aligning with said first and second strap apertures; and a fastener, passable through said first strap aperture, said brace aperture and said second strap aperture to constrict said receiver and secure said body with respect to said strap, said first and second chassis apertures and said fastener cooperating to secure said retention bracket with respect to said wall and thereby said outlet end with said chassis plug.

2. The bracket as recited in claim 1 wherein said strap has a shape that conforms to a perimeter of said body.

3. The bracket as recited in claim 1 wherein said outlet end contains an International Electrotechnical Commission (IEC) connector.

4. The bracket as recited in claim 1 wherein said strap comprises metal.

5. The bracket as recited in claim 1 wherein said second strap aperture is bounded by threads.

6. The bracket as recited in claim 1 wherein said fastener is a single bolt.

7. The bracket as recited in claim 1 further comprising first and second chassis anchor offsets, interposed between said strap and said first and s econd chassis anchors, respectively, that increase a separation of said first and second chassis anchors.

8. A method of securing an outlet end of a line cord to a chassis plug mounted to a wall of an electronics chassis, comprising:

inserting a body of said outlet end into a receiver of a strap, said strap terminating in first and second locking members projecting radially from said receiver and having corresponding alignable first and second strap apertures;

engaging said outlet end with said chassis plug, first and second chassis anchors projecting from said strap in a direction substantially parallel to a centerline of said receiver and locking with said wall via corresponding chassis apertures therein, a brace projecting from said wall and having a brace aperture aligning with said first and second strap apertures; and passing a fastener through said first strap aperture, said brace aperture and said second strap aperture to constrict said receiver and secure said body with respect to said strap, said first and second chassis apertures and said fastener cooperating to secure said retention bracket with respect to said wall and thereby said outlet end with said chassis plug.

9. The method as recited in claim 8 wherein said strap has a shape that conforms to a perimeter of said body.

10. The method as recited in claim 8 wherein said outlet end contains an International Electrotechnical Commission (IEC) connector.

11. The method as recited in claim 8 wherein said strap comprises metal.

12. The method as recited in claim 8 wherein said second strap aperture is bounded by threads, said method further comprising the step of turning said fastener to engage said fastener with said threads.

13. The method as recited in claim 8 wherein said fastener is a single bolt.

14. The method as recited in claim 8 wherein first and second chassis anchor offsets increase a separation of said first and second chassis anchors.

* * * * *